US005460141A

United States Patent [19]

Denz et al.

[11] Patent Number: 5,460,141

[45] Date of Patent: Oct. 24, 1995

[54] METHOD AND APPARATUS FOR CHECKING THE TIGHTNESS OF A TANK-VENTING SYSTEM

[75] Inventors: Helmut Denz, Stuttgart; Ernst Wild, Oberriexingen; Andreas Blumenstock, Ludwigsburg, all of Germany

[73] Assignee: Robert Bosch GmbH, Stuttgart, Germany

[21] Appl. No.: 246,518

[22] Filed: May 20, 1994

[30] Foreign Application Priority Data

May 27, 1993 [DE] Germany ..... 43 17 634.8

[51] Int. Cl.[6] ..... F02M 33/02

[52] U.S. Cl. ..... 123/520; 123/198 D

[58] Field of Search ..... 123/520, 516, 123/518, 519, 521, 198 D

[56] References Cited

U.S. PATENT DOCUMENTS

| | | | |
|---|---|---|---|
| 5,195,498 | 3/1993 | Siebler | 123/520 |
| 5,197,442 | 3/1993 | Blumenstock | 123/520 |
| 5,261,379 | 11/1993 | Lipinski | 123/520 |
| 5,265,577 | 11/1993 | Denz et al. | 127/198 D |
| 5,275,144 | 1/1994 | Gross | 123/520 |
| 5,295,472 | 3/1994 | Otsuka | 123/198 D |
| 5,339,788 | 8/1994 | Blumenstock | 123/520 |

*Primary Examiner*—Carl S. Miller
*Attorney, Agent, or Firm*—Walter Ottesen

[57] ABSTRACT

The invention is directed to a method for checking the tightness of a tank-venting system when a pregiven test condition is satisfied. The method includes the steps of: (a) building up a difference pressure in the tank-venting system irrespective of whether the pregiven test condition is satisfied; (b) determining the presence of the test condition and then closing the tank-venting system; (c) determining the value of the decay gradient of the difference pressure when the pregiven test condition is satisfied thereby losing no time in starting the check of the tightness; and, (d) drawing a conclusion as to the tightness of the tank-venting system when the value of the decay gradient is less in magnitude than a threshold decay gradient. In this way, as soon as the test condition is satisfied, a determination of the value of the decay gradient of the difference pressure already built up can be started. An apparatus for carrying out the method is also disclosed.

8 Claims, 4 Drawing Sheets

METHOD AND APPARATUS FOR CHECKING THE TIGHTNESS OF A TANK-VENTING SYSTEM

FIELD OF THE INVENTION

The invention relates to a method and an apparatus for checking the tightness of a tank-venting system on an internal combustion engine.

BACKGROUND OF THE INVENTION

A tank-venting system of the kind which is of interest here has basically the following assembly groups: a tank; an adsorption filter which is connected to the tank via a tank connection line; the adsorption filter further having a venting line which can be closed by a venting check valve; and, a tank-venting valve in a valve line which connects the adsorption filter to the intake pipe of the corresponding internal combustion engine.

At the present time, the most important class of methods for checking the tightness of a tank-venting system is based on the generation of a difference pressure in the system. This difference pressure can either be an overpressure relative to the ambient pressure or it can be an underpressure. In order to generate an underpressure, the venting line on the adsorption filter is closed and the tank-venting valve is opened. In this way, the tank-venting system can be evacuated with the aid of the underpressure in the intake pipe. In the case of generating an overpressure, the venting line is likewise closed and, with the aid of a blower, air is forced into the system. Typically, a difference pressure of approximately 10 hPa is generated.

A soon as the desired test difference pressure is reached, the tank-venting system can be closed entirely and the value of the decay gradient of the built-up difference pressure is determined. If the system is tight, then the difference pressure decays only very slowly; otherwise, the decay is relatively rapid. A conclusion can therefore be drawn as to the condition of tightness when the determined value is less than a threshold decay gradient for the difference pressure.

It is obvious that the decay gradient for the difference pressure is not only influenced by unwanted inflowing air but also by vapor which vaporizes from the fuel in the tank. Such vaporization occurs almost always when the contents of the tank move with intensity. For this reason, known methods provide that the above-described tightness check is only then carried out when a condition is satisfied which makes it probable that the test result is not falsified by the vaporizing fuel. In the simplest case, the check comprises that in advance of the closure of the tank-venting valve, a check is made as to whether the mixture control had to carry out a lean correction in the time span with the tank-venting valve open. This is then the case when air enriched with fuel vapor inflows from the tank-venting system. More reliable statements are obtained with a complex test condition which not only inquires as to the just-mentioned lean correction but also checks whether the motor vehicle is moved so that the contents of the tank are probably likewise moved. For this purpose, an inquiry can be made as to whether the motor vehicle, on which the tank-venting system is mounted, is at standstill. Additionally, a check can be made as to whether idle is present. Corresponding methods are, for example, described in U.S. patent application Ser. No. 08/070,334, filed May 26, 1993, and incorporated herein by reference.

The conventional methods, which provide a conclusion as to the tightness of the tank-venting system with the aid of a difference pressure decay gradient, have the following general steps in common: making a check as to whether a condition, which can include several subsidiary conditions, is satisfied, which permits a reliable tightness check to be expected; when this condition is satisfied, generating a difference pressure (overpressure or underpressure) in the system and closing the system when a pregiven difference pressure is reached; determining the value of the decay gradient of the built-up difference pressure; and, drawing a conclusion as to tightness of the system when the determined value is less than a threshold decay gradient.

The known arrangements are configured to carry out such a method.

It is apparent that a check with the aid of the above-mentioned decay gradient is that much more precise the greater the time span and pressure range are over which this decay gradient is determined. It would therefore be ideal to set relatively high difference pressures of, for example, 100 hPa. The selection of a high difference pressure and a long test time are, however, contrary to various aspects. A first aspect is that in the case of adjusting underpressure, the fuel vaporizes with increasing intensity which, as explained above, falsifies the test result. A second aspect is that the fuel tank is sensitive to pressure and is especially sensitive in the underpressure range. A third aspect and the most important one listed here is the test time. Attention is here called to the fact that the above-mentioned conditions, for which especially reliable test results can be expected, occur only infrequently and then not for a time span which is very long. In conventional methods, the entire time span for the build-up of the difference pressure and for the determination-of the decay gradient should amount to not more than a few ten-second intervals, for example, not more than 30 to 40 seconds.

The conventional methods use relatively low difference pressures in order to operate with total test time spans of this kind. For this purpose, a value of approximately 10 hPa was already mentioned.

SUMMARY OF THE INVENTION

It is an object of the invention to provide a method and an apparatus for checking the tightness of a tank-venting system within the shortest possible test time span.

The method of the invention is for checking the tightness of a tank-venting system when a pregiven test condition is satisfied. The method includes the steps of: (a) building up a difference pressure in the tank-venting system irrespective of whether the pregiven test condition is satisfied; (b) determining the presence of the test condition and then closing the tank-venting system; (c) determining the value of the decay gradient of the difference pressure when the pregiven test condition is satisfied thereby losing no time in starting the check of the tightness; and, (d) drawing a conclusion as to the tightness of the tank-venting system when the value of the decay gradient is less in magnitude than a threshold decay gradient.

The method of the invention is distinguished from the conventional methods in that the build-up of the test difference pressure is not only started when the condition (individual or composite condition) for conducting the tightness test is satisfied; instead, the test difference pressure is built up completely independently thereof. As soon as the above-mentioned condition is satisfied, the tank-venting system can be closed in order to determine the value of the decay gradient of the difference pressure which has already built up. Accordingly, the actual test time span comprises only the time span which is required to determine the decay gradient; whereas, within the time span, no portion is required for building up the test difference pressure. This time portion for the difference pressure build-up was included in the total test time span in conventional methods (for a satisfied test condition) and this time span was especially then very long when the difference pressure was to be built up in a tank which was almost empty.

When the test difference pressure is an underpressure, this underpressure is built up as described above in that the tank-venting valve is opened and the venting line on the adsorption filter is closed. The test difference pressure then is adjusted in that either the pulse-duty factor of the drive of the tank-venting valve is varied when the venting line is completely closed or the pulse-duty factor of the drive of the venting check valve is varied with the pulse-duty factor for the tank-venting valve with the pulse-duty factor being determined by the usual regenerating function. In both cases, vapor from the tank-venting system reaches the internal combustion engine. If the vapor drawn in by suction contains fuel, then a lean correction in the mixture control is necessary. This opens the possibility to decide whether the tank-venting system should continue to be so operated that the test difference pressure is adjusted or whether the usual regeneration of the adsorption filter without underpressure adjustment should be effected. As a rule, the last-mentioned possibility is selected when the regenerating gas flow is recognized as being charged with fuel. The method of the invention does not have this disadvantage since it should be noted that, when a lean correction is determined, the fuel vaporizes so intensely that, in any case, no tightness test of the above-mentioned kind can be carried out. It is then of no consequence if the test underpressure is not adjusted when the test condition is suddenly satisfied because one would not switch over to a determination of the value of the decay gradient since no reliable test results could be expected.

If the method of the invention is carried out in combination with the test of the decay gradient of an overpressure, then it is to be noted that the overpressure, as a rule, builds up with the tank-venting valve closed. It is then, however, not possible to check with the aid of a lean correction as to whether the fuel is vaporizing and therefore a venting should actually be made. In this context, it is problematical to attempt to adjust the test overpressure even when the test condition is not at all satisfied. According to a further embodiment of the invention, this problem is, however, avoided in that monitoring is conducted to determine whether the difference pressure increases above a pressure threshold which can only be exceeded when the fuel vaporizes. As soon as this threshold is exceeded, the build-up of the test pressure is dispensed with and the operation of the system is switched over to optimal venting.

The procedure described for an operation with overpressure can also be used in the case of generating underpressure. This is done in the following context. In order to maintain the underpressure in the tank-venting system even in times in which no vapor from the tank-venting system is to be supplied to the intake pipe because of an adaptation of the mixture control, the tank-venting system is tightly closed in these time spans by closing the tank-venting valve and the venting check valve. If the fuel begins to vaporize, for example, because of considerable movement of the contents of the tank, then the underpressure in the tank increases when seen absolutely, that is, the underpressure approaches the ambient pressure. Here too, a pressure threshold can be pregiven at which a switchover takes place to tank venting when this threshold is exceeded.

As a rule, it is also advantageous to activate the difference pressure control only for a certain time span beginning with the start of the engine, for example, for ten minutes in order not to have to accept a more intense vaporization of fuel at underpressure during the entire operating time of the engine or, for overpressure, when a very small leak is present, to have to continuously blow fuel vapor through this leak. If the test condition is not satisfied within the pregiven time span, a check is made in a conventional manner without a precautionary difference pressure build-up.

The value of the decay gradient of the difference pressure already built up can be determined as soon as the test condition is satisfied by utilizing the method and arrangement of the invention. To achieve this, it is either possible to shorten the actual test time or, for the same total test time as previously, the decay gradient can be followed over a larger pressure range than previously which increases the precision of the results of the test method.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
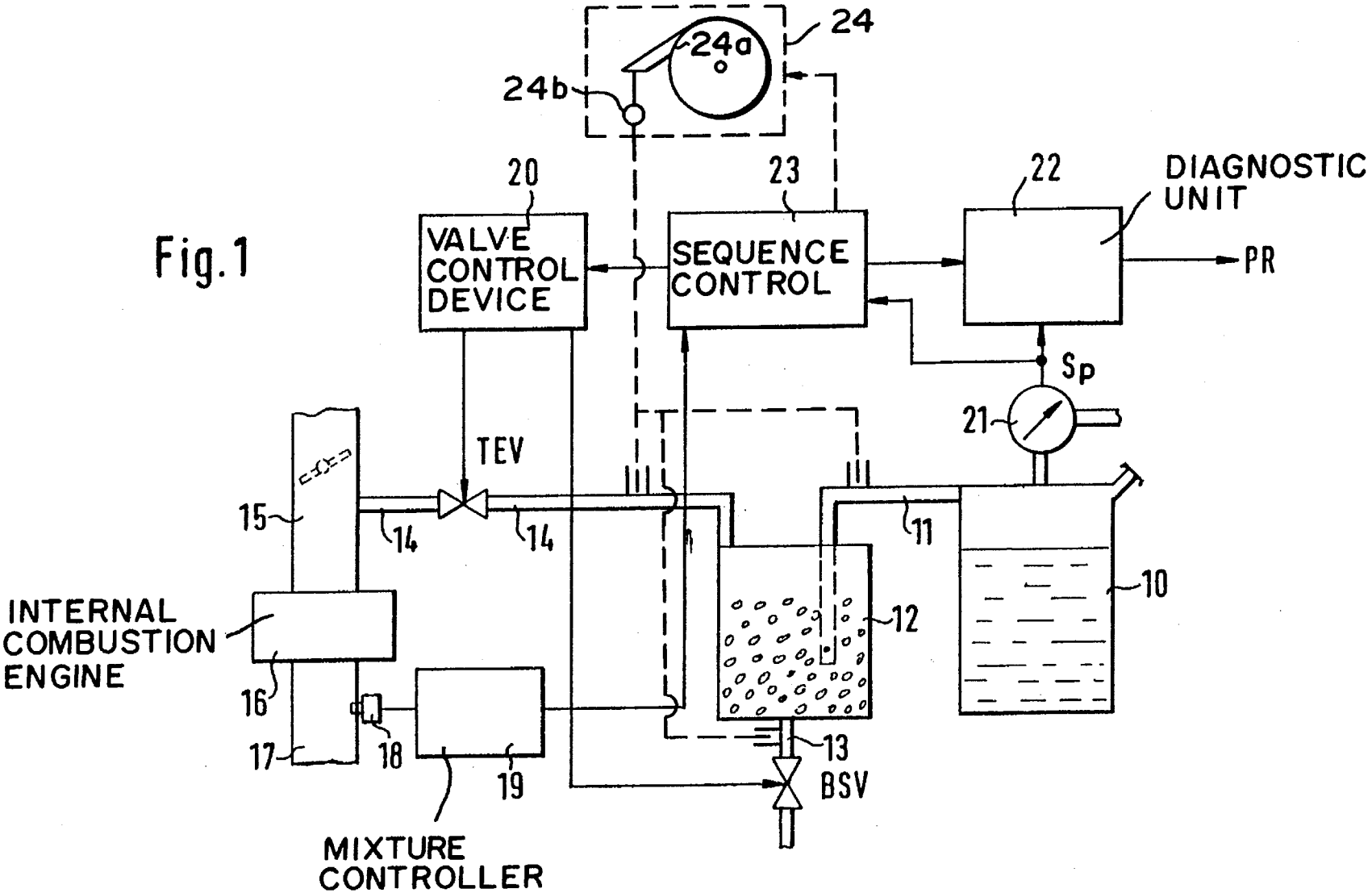
FIG. 1 is a block circuit diagram of a tank-venting system equipped with an arrangement of the invention for checking the tightness of the system.

The tank-venting system shown in FIG. 1 includes a tank 10 which is connected to an adsorption filter 12 via a tank connection line 11. The adsorption filter 12 has a venting line 13. The adsorption filter 12 is also connected to the intake pipe 15 of an internal combustion engine 16 via a valve line 14 in which a tank-venting valve TEV is mounted. An oxygen probe 18 is disposed in the exhaust-gas channel 17 of this internal combustion engine. The output signal of the oxygen probe 18 is supplied to a mixture controller 19.

The following components operate when checking the tightness of the tank-venting system: the above-mentioned tank-venting valve TEV, the mixture controller 19, a venting check valve BSV which is connected into the venting line 13, a valve control device 20 for driving the tank-venting valve and the venting check valve and a difference pressure sensor 21 on the tank. The difference pressure sensor 21 measures the difference pressure (p) in the tank and emits a corresponding pressure signal Sp to a diagnostic unit 22 and a sequence control 23. The sequence control 23 controls the operation of the valve control device 20 and the diagnostic unit 22. The diagnostic unit 22 supplies a test signal PR which shows whether the system is tight or not tight, for example, with values "0" or "1".

Figure 2:
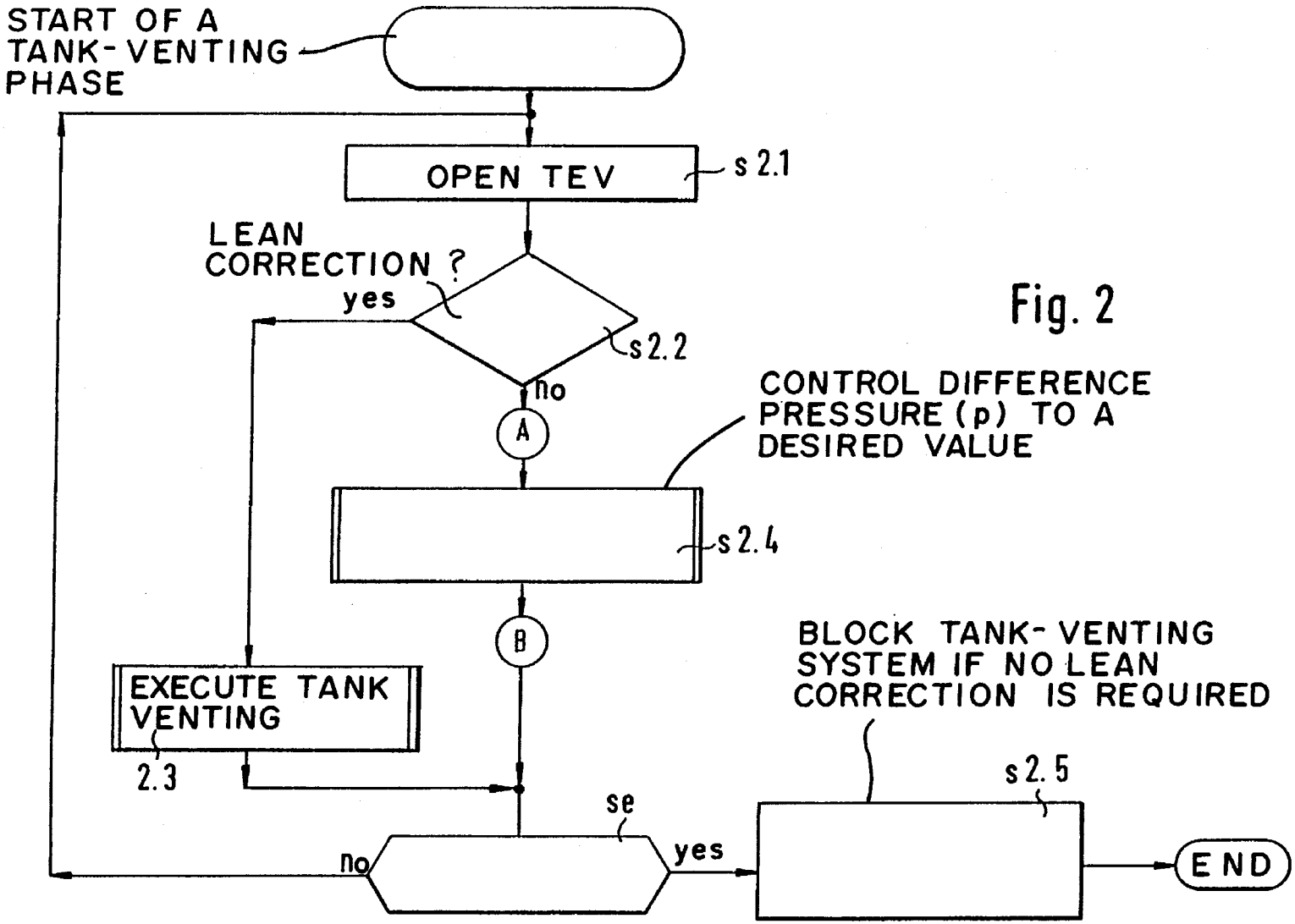
FIG. 2 is a flowchart for an embodiment of the method of the invention for checking the tightness of a tank-venting system.

The sequence control 23 operates the system of FIG. 1 generally pursuant to a method as shown in the flowchart of FIG. 2.

The sequence control first checks whether a tank-venting phase or a so-called base adaptation phase is to be set in which an adaptation of the precontrol values of the mixture controller 19 takes place. As a rule, these phases alternate pursuant to a fixed time rhythm with a period of several minutes. As soon as the sequence control 23 determines that a tank-venting phase begins, the sequence control 23 starts the method according to the flowchart of FIG. 2. After the start, the sequence control 23 controls the valve control device 20 in step s2.1 so that device 20 opens the tank-venting valve TEV at a pregiven pulse-duty factor. In step s2.2, a check is made as to whether the mixture controller 19 must carry out a lean correction which is then the case when the vapor drawn by suction from the tank-venting system into the intake pipe 15 contains fuel. If this is the case, then tank venting takes place in a manner known per se in a subprogram step s2.3. Otherwise, another subprogram step s2.4 follows in which a difference pressure (p) is controlled in tank 10 to a desired value. The subprogram step s2.4 lies between marks A and B. Examples for the detailed sequence of the subprogram step are shown in the flowcharts of FIGS. 3 and 4.

An end step se follows each of the two above-mentioned subprogram steps s2.3 or s2.4 wherein the inquiry is made as to whether the end of the tank-venting phase is present. If this is not the case, then the above-mentioned sequence starts again with the step s2.1. Otherwise, the tank-venting system is blocked in a step s2.5 if no lean correction was required. This operates to maintain the difference pressure built up in step s2.4.

Independently of whether a tank-venting phase or a base adaptation phase is present, the sequence control 23 continuously checks whether an operating state of the motor vehicle occurs which permits a reliable tightness check to be made in that the tank-venting system is closed and the value of the decay gradient of the built-up difference pressure is determined which then is compared to a threshold decay gradient in order to draw a conclusion as to the tightness of the system. No flowchart is shown for this method sequence of the sequence control 23 since this is concerned primarily with a known sequence. The only difference with respect to the known sequence is that, when the test condition occurs, a start can be immediately made to determine the value of the decay gradient; whereas, for a method of the state of the art, the desired test difference pressure must first be built up before the tank-venting system can be blocked in order to determine the value of the decay gradient.

Figure 3:
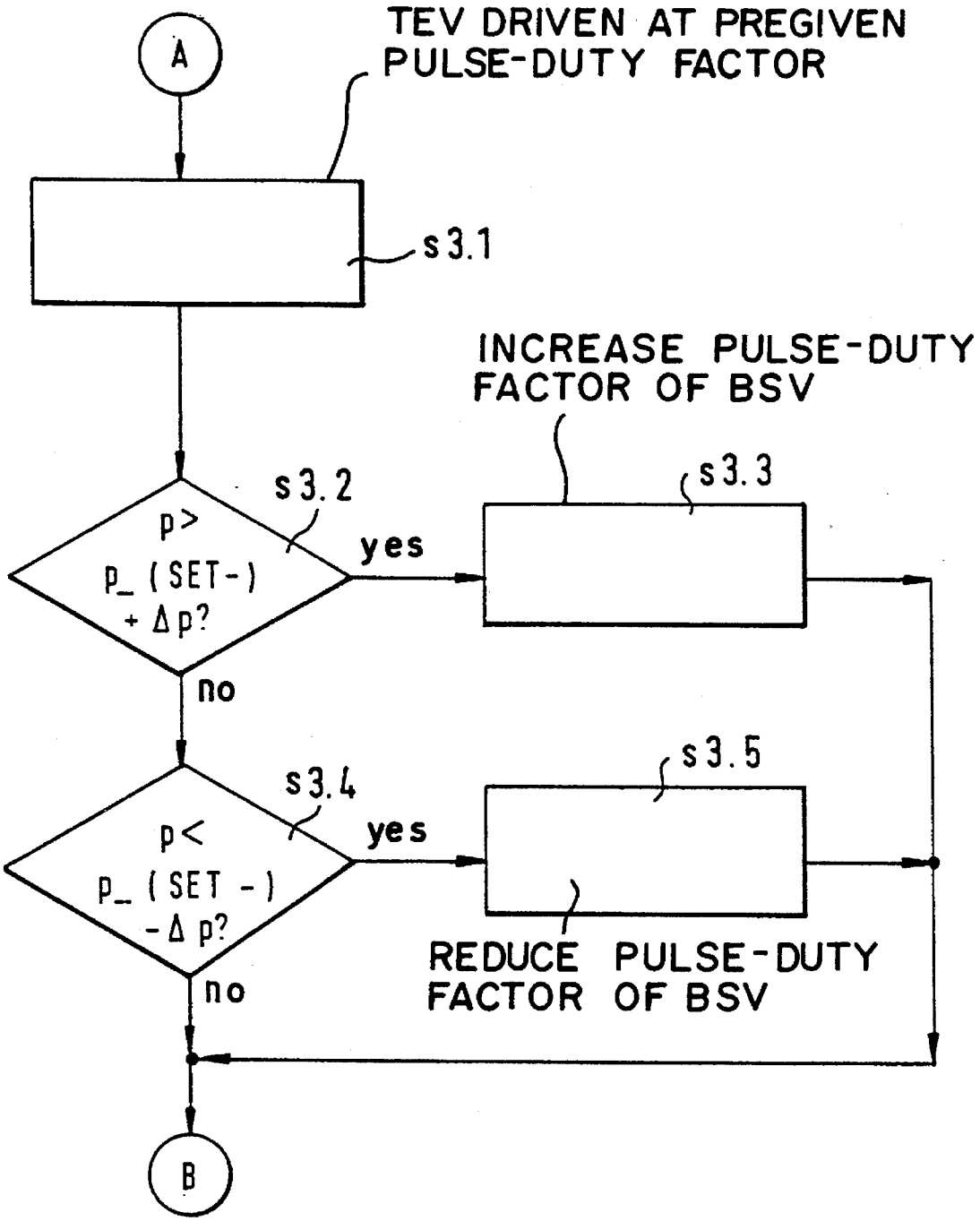
FIG. 3 is a detailed flowchart for the section between the marks A and B shown in FIG. 2 for the case of a tightness test with the aid of underpressure; and, FIG. 4 is a detailed flowchart corresponding to the flowchart of FIG. 3 but for the case of a test with the aid of overpressure in the tank-venting system.
Figure 4:
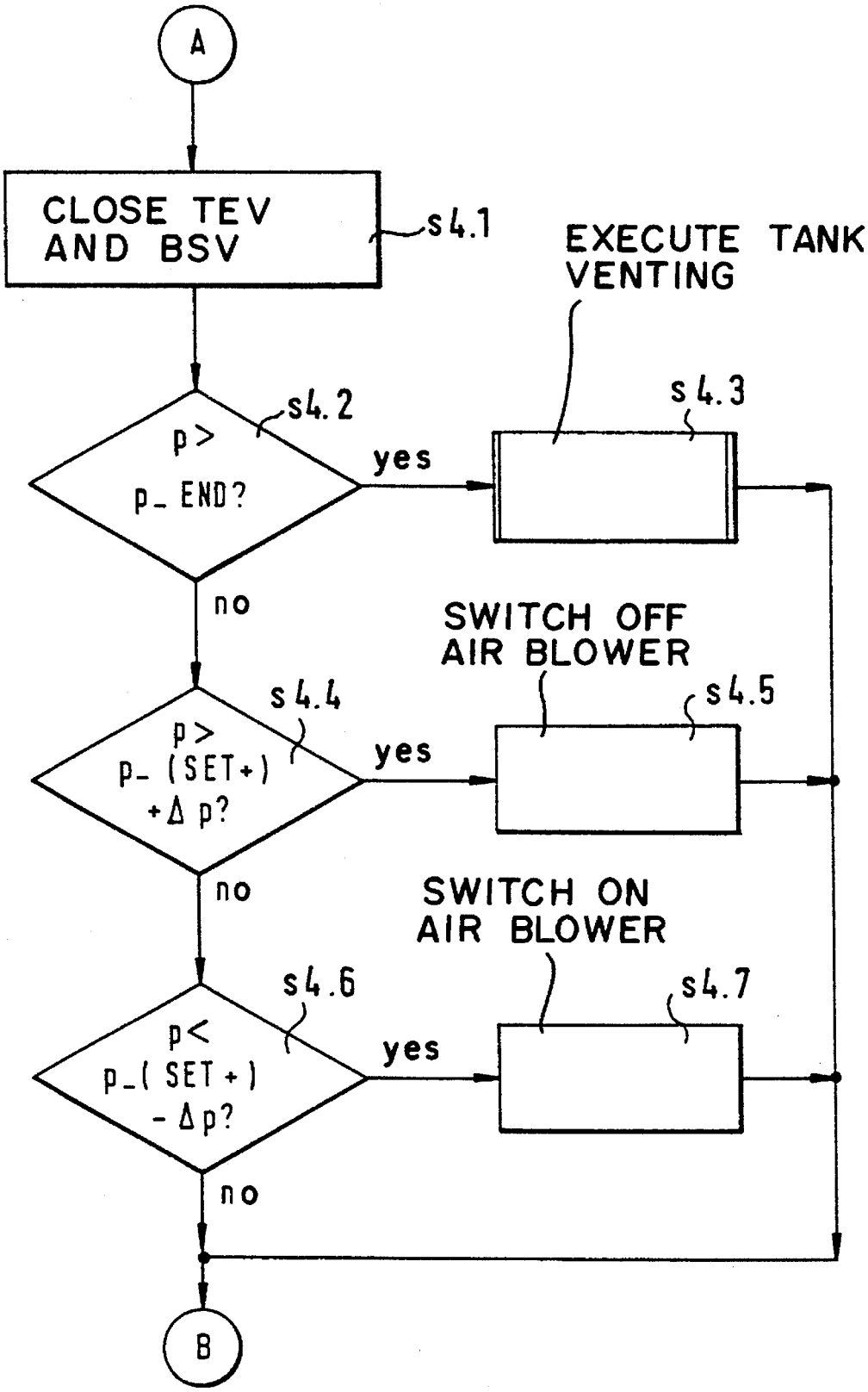

The flowchart of FIG. 3 shows a simple procedure for carrying out the subprogram step s2.4 for the case wherein a pregiven test underpressure p_(SET—) of, for example, −15 hPa, is built up in the tank-venting system.

In step s3.1, after the mark A, the tank-venting valve TEV is driven by the valve control device 20 at a pregiven pulse-duty factor. In the next step s3.2, an inquiry is made as to whether the tank difference pressure (p) still is above the test underpressure. Stated more precisely, a check is made as to whether p>p_(SET—)+Δp is applicable. Δp is here a hysteresis variable which assists in that the two-point control method of FIG. 3 does not continuously switch back and forth control variables at a mandatory threshold; instead, no changes are undertaken within the range of the width 2 Δp.

If the condition inquired of in step s3.2 is satisfied, then the actually still present pulse-duty factor of the venting check valve BSV is increased in step s3.3. A desired value is pregiven at the start of the sequence of FIG. 2 for the pulse-duty factor of the venting check valve. Alternatively to the outputting of a pulse-duty factor for the venting check valve BSV, a simple on-off control is possible wherein the venting check valve is closed when a pregiven difference pressure threshold is exceeded and is opened when there is a drop below a pregiven difference pressure threshold.

If the condition inquired of in step s3.2 is not satisfied (that is, if the underpressure in the tank is already below the checked threshold), an inquiry is made in step s3.4 as to whether the condition p<p_(SET—)−Δp is satisfied. If this is the case, then the pulse-duty factor of the venting check valve BSV is reduced in step s3.5. Otherwise, the mark B is reached without further change of the control signals.

As can be seen from this sequence, the underpressure in the tank is adjusted approximately to the value p_(SET—) in that the tank-venting valve is continuously driven at a pulse-duty factor given by the normal regenerating sequence or, that the venting check valve is opened or closed in the context of a two-point control in order to permit more or less air to flow into the tank-venting system. Another possibility of pressure control would be to completely close the venting check valve and to vary the pulse-duty factor of the tank-venting valve to control pressure. The procedure described with respect to FIG. 3 affords the advantage that essentially constant quantities of vapor continuously flow from the tank-venting system which the mixture controller 19 can excellently consider.

The flowchart of FIG. 4 shows an embodiment for the subprogram step s2.4 for the case of the adjustment of overpressure in a tank-venting system. The tank-venting system shown in FIG. 1 cannot be used here directly. This system must be modified in that a blower is present which forces air into the tank-venting system. A separate blower can be used or a charger connected to the intake pipe 15.

The separate blower and a blower unit corresponding thereto are shown in FIG. 1 in phantom outline to emphasize the exemplary character of this embodiment. Reference numeral 24 identifies the blower unit which includes the blower **24*a* and a check valve 24*b*. The check valve prevents the built-up overpressure from decaying via the blower 24*a* itself after the blower is switched off. The blower can be connected into any one of the lines 11, 13 or 14** as shown.

According to the sequence of FIG. 4, and after passing through mark A, the tank-venting valve TEV and the venting check valve BSV are closed in step s4.1. In step s4.2, a check is made as to whether the overpressure (p) in the tank is greater than a terminating pressure pn for the entire method. This terminating pressure can, for example, be 20 hPa. This condition is then satisfied when the test underpressure was previously reached and the fuel began to vaporize with greater intensity with the system closed, for example, because the fuel was set into motion because of a jolt. This vaporization of fuel can be detected in that the overpressure in the tank is significantly greater than the test overpressure and increases over the terminating pressure. In this case, a step s4.3 is reached wherein a tank venting is carried out. The step s4.3 is therefore similar to step s2.3.

If the condition inquired in step s4.2 is not satisfied, a check is made in step s4.4 as to whether the overpressure is greater than the test overpressure p_(SET+) which can, for example, be 15 hPa. Stated more precisely, a check is made as to whether p<p_(SET+)+Δp applies. Here, the variable Δp can have the same significance as it has in the sequence explained with respect to FIG. 3. If the condition is satisfied, then the above-mentioned air blower (not shown in FIG. 1) can be switched off (step s4.5). Since the tank-venting system is then completely closed, the overpressure drops only slightly in the case of a tight system. However, if the pressure again drops below the test underpressure, the air blower is again switched on in step s4.7. The switch-on of the air blower is performed while considering the hysteresis variable Δp which was interrogated in step s4.6 (inquiry: p<(p_SET+)−Δp?). If in contrast, the underpressure (p) is still in the hysteresis range, then mark B is reached without further measures after step s4.6.

It is noted that the method of FIG. 4 can also be run in the base adaptation phases; whereas, this does not apply for the method of FIG. 3. In the method of FIG. 4, the tank-venting system is completely closed with respect to the ambient as long as an overpressure does not develop which is so high that it indicates vaporizing fuel. Only then the tank-venting valve is opened in order to pass the fuel vapor occurring in the system to the intake pipe 15 and therefore to the engine 16. Since the tank venting is very important, a then running base adaptation phase is concluded in such a case in order to immediately start the tank-venting phase. As explained above, the step s4.3 can also be triggered in that (alternatively to step s4.2 or in addition to this step) a check is made as to whether an increase in pressure above a threshold is present when the system is completely blocked, that is, without a supply of air from the blower.

The method of FIG. 3 only runs so long as the tank-venting system can be evacuated from the intake pipe 15 via the tank-venting valve TEV. This is only the case in tank-venting phases. The tank-venting valve is closed during phase adaptation phases. If the venting check valve BSV is closed when ending the tank-venting phase, the built-up underpressure is maintained at least to a certain extent but can drop in magnitude below the test difference pressure. If an operating state now suddenly occurs wherein the test condition for the tightness check is satisfied, a start cannot be made directly to determine the value of the decay gradient of the difference pressure; instead, the difference pressure must again be completely built up. In view of this fact, it is advantageous to modify the method explained with respect to FIG. 3 such that the pressure p_(SET—) is in magnitude pregiven somewhat greater than the test difference pressure, for example, at −18 hPa. If this pressure is present when an operating state occurs for which the condition is satisfied, the venting check valve BSV must only be opened for a very short time in order to adjust the test difference pressure. If several minutes pass starting from blocking the system, the difference pressure can drop in magnitude to the test underpressure. Then, a start can be immediately made to determine the value of the decay gradient.

In a still further refinement of the sequence of the method, it is possible to control the underpressure relatively precisely to the test difference pressure during the tank-venting phase in order to immediately start with the determination of the value of the decay gradient as soon as an operating state for which the test condition is satisfied. In contrast, and shortly before the end of the tank-venting phase, the underpressure is increased somewhat in magnitude so that it does not drop below the test difference pressure even during the following base adaptation phase. In this way, the determination of the decay gradient can be started at any time during the base adaptation phase.

It is understood that the foregoing description is that of the preferred embodiments of the invention and that various changes and modifications may be made thereto without departing from the spirit and scope of the invention as defined in the appended claims.

What is claimed is:

1. A method for checking the tightness of a tank-venting system when a pregiven test condition is satisfied, the method comprising the steps of:

(a) building up difference pressure in said tank-venting system irrespective of whether said pregiven test condition is satisfied;

(b) determining the presence of said test condition and then closing said tank-venting system;

(c) determining the value of the decay gradient of said difference pressure when said pregiven test condition is satisfied thereby losing no time in starting the check of said tightness; and, (d) drawing a conclusion as to the tightness of said tank-venting system when said value of said decay gradient is less in magnitude than a threshold decay gradient.

2. A method for checking the tightness of a tank-venting system when a pregiven test condition is satisfied, the method comprising the steps of:

(a) building up difference pressure in said tank-venting system irrespective of whether said pregiven test condition is satisfied only when no lean correction of a mixture controller on the internal combustion engine has been determined during scavenging of an adsorption filter of said tank-venting system;

(b) determining the presence of said test condition and then closing said tank-venting system;

(c) determining the value of the decay gradient of said difference pressure when said pregiven test condition is satisfied thereby losing no time in starting the check of said tightness; and, (d) drawing a conclusion as to the tightness of said tank-venting system when said value of said decay gradient is less in magnitude than a threshold decay gradient.

3. The method of claim 2, the method comprising building up said difference pressure only during tank venting phases.

4. The method of claim 3, the method comprising building up said difference pressure only within a pregiven time span after the start of the engine connected to said tank-refuting system.

5. The method of claim 4, the method comprising the step of terminating the closed state of said tank-venting system when it has been determined that the pressure in said tank-venting system has increased above a pregiven pressure threshold (p_END).

6. An apparatus for checking the tightness of a tank-venting system when a pregiven test condition is satisfied, the apparatus comprising:

difference pressure generating means for generating a difference pressure in the tank-venting system irrespective of whether said pregiven test condition is satisfied;

a diagnostic unit for determining the value of the decay gradient of the difference pressure built up in said tank-venting system;

said diagnostic unit being adapted to determine said value when said pregiven test condition is satisfied and said tank-venting system has been closed off;

means for determining when said value of said decay gradient is less than a threshold decay value thereby facilitating a conclusion to be drawn as to the tightness of said tank-venting system;

sequence control means for controlling the operation of said difference pressure generating means and said diagnostic unit; and, said sequence control means being adapted to drive said difference pressure generating means so as to cause said difference pressure to be built up even when said test condition is not satisfied.

7. The apparatus of claim 6, wherein said difference pressure is generated before said pregiven test condition is satisfied.

8. The method of claim 1, wherein said difference pressure is generated before said pregiven test condition is satisfied.

* * * * *

UNITED STATES PATENT AND TRADEMARK OFFICE
CERTIFICATE OF CORRECTION

PATENT NO. : 5,460,141

DATED : October 24, 1995

INVENTOR(S) : Helmut Denz, Ernst Wild and Andreas Blumenstock

It is certified that error appears in the above-identified patent and that said Letters Patent is hereby corrected as shown below:

In column 2, line 31: delete "determination-of" and substitute -- determination of -- therefor.

In column 6, line 48: delete "pn" and substitute -- $p_n$ -- therefor.

In column 8, line 40: delete "tank-refuting" and substitute -- tank-venting -- therefor.

Signed and Sealed this

Third Day of September, 1996

*Attest:*

*Attesting Officer*

BRUCE LEHMAN

*Commissioner of Patents and Trademarks*